United States Patent [19]

Schwartz

[11] 4,057,520

[45] Nov. 8, 1977

[54] SLIDE SWITCH ASSEMBLY HAVING FLEXIBLE HOUSING WITH MOVABLE CONTACTS MOUNTED ON PRINTED CIRCUIT BOARD

[75] Inventor: Edwin L. Schwartz, Los Angeles, Calif.

[73] Assignee: Rite Autotronics Corporation, Los Angeles, Calif.

[21] Appl. No.: 729,780

[22] Filed: Oct. 5, 1976

[51] Int. Cl.[2] ..... H01H 15/04; H01H 9/02

[52] U.S. Cl. ..... 200/16 D; 200/295; 200/303

[58] Field of Search ..... 200/16 R, 16 C, 16 D, 200/77, 275, 291, 292, 295, 303, 293

[56] References Cited

U.S. PATENT DOCUMENTS

| | | | |
|---|---|---|---|
| 3,525,828 | 8/1970 | Eckhart et al. | 200/16 D |
| 3,592,983 | 7/1971 | Kroll et al. | 200/16 D |
| 3,674,953 | 7/1972 | Brevick | 200/16 D X |
| 3,983,341 | 9/1976 | Stanish | 200/16 D |
| 4,016,378 | 4/1977 | Arthur | 200/16 D |

*Primary Examiner*—James R. Scott
*Attorney, Agent, or Firm*—Robert E. Geauque

[57] ABSTRACT

One embodiment of the herein disclosed switching arrangement comprises a printed circuit board having two parallel slots formed therein with a plurality of contact points disposed between the slots; and a housing mounted so as to allow its movement along the slots and including at least one electrically conductive member mounted within a cavity in the housing such that for different positions of the housing along the slots in the printed circuit board different ones of said contact points are shorted together.

4 Claims, 9 Drawing Figures

SLIDE SWITCH ASSEMBLY HAVING FLEXIBLE HOUSING WITH MOVABLE CONTACTS MOUNTED ON PRINTED CIRCUIT BOARD

BACKGROUND OF THE INVENTION

Printed circuit boards are widely used for mounting and interconnecting electrical components and have provided substantial savings in fabrication of costs of electrical devices. In many applications, switching functions are required whereby, for example, an electrical contact point may be selectively connected to one of two other contact points. Heretofore, it has been the normal practice to implement switching functions in printed circuit designs by mounting a suitable conventional electrical switch on an associated chassis and wiring the appropriate electrical contact points from the printed circuit board to terminals of the switch. Such a configuration not only involves the expense of wiring the printed circuit board to the switch, but also the cost of mounting the switch to the chassis.

SUMMARY OF THE INVENTION

A primary object of the subject invention is to provide a new switching means for printed circuits which is economical and reliable.

A further object of the invention is to provide a new switching device which selectively interconnects contact points on a printed circuit board without requiring electrical wiring from the printed circuit board to the switch.

Another object of the subject invention is to provide an electrical switch device which is adapted for mounting directly on a printed circuit board and which does not require electrical wiring to the printed circuit board.

A still further object of the invention is to provide a new switching means for printed circuits which is economical to produce and assemble.

Briefly, the subject invention comprises a housing adapted for mounting at least one contact member and having side members extending below the body thereof. For single-pole-double-throw (SPDT) configurations, a single contact member is used and the printed circuit board has three contact points or pads disposed between two slots in the printed circuit board. The end of each of said side members remote from the main portion of the housing is terminated in outwardly protruding lateral lips. The spacing between the slots in the printed circuit board and the side members are such that when the side members are projected through the slots, the lips engage the underside of the printed circuit board contiguous to the outer edges of the slots.

The contact member is made of spring metal and its height is slightly greater then the depth of its mounting cavity in the housing of the switch. Hence, the compressed contact member maintains pressure between the lips of the side members and the underside of the printed circuit board. This configuration also ensures a good electrical connection between the contact member and the pads on the printed circuit board.

The length of the segment of the contact member which slides on the printed circuit board is selected such that when the housing is at one end of its travel along the slots in the printed circuit board the central contact point or pad and one of the two end pads are shorted together by the metallic contact member. In the other end of its travel along the slots in the printed circuit board, the contact member shorts the central pad and the opposite end pad. The length of the portion of the contact member in engagement with the printed circuit board and the spacing between the contact pads determines whether a "make before break" or a "break before make" type of switch is implemented.

By using a plurality of parallel contact members with associated pads on the printed circuit board, the hereinabove described switch configuration may be extended to as many "poles" as required. For example, a double-pole-double-throw configuration would use two parallel contact members with a set of pads on the printed circuit board associated with each one of the contact members.

The novel features of the invention are set forth with particularity in the appended claims. The invention will be best understood from the following description when read in conjunction with the accompanying drawings in which like reference characters refer to like parts.

BRIEF DESCRIPTION OF THE SHOWN EMBODIMENT

Referring first to the double-pole-double-throw switch arrangement of FIGS. 1–8, a housing 10 which may be form molded from a plastic such as debrin, for example, has two side members 12 and 14 (FIG. 4) which extend below the body thereof. The ends of side members 12 and 14, remote from the main portion of the housing, are terminated in outwardly protruding lateral lips 16 and 18, respectively.

Figure 3:
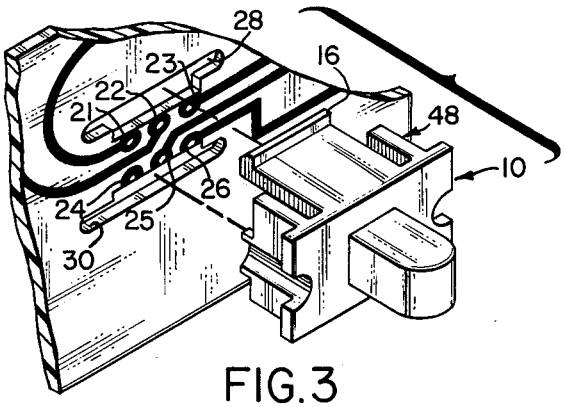
FIG. 3 is a perspective view of said switching arrangement with the switch housing removed from the printed circuit board.

Printed circuit board 20, which may be any suitable conventional type of printed circuit board, has two linear sets of contact points or pads, with a first set comprising pads 21–23 and the second set pads 24–26, (See FIG. 3). Slots 28 and 30 are provided in printed circuit board 20 and said slots are parallel to lines defined by pads 21–23 and 24–26.

Contact members 32 and 34 are disposed in cavities 36 and 38, respectively, formed within housing 10. The height of members 32 and 34 is slightly more than the depth of cavities 36 and 38.

Slots 28 and 30 have enlarged central portions which allow the passage of lips 16 and 18, respectively. The spacing between side members 12 and 14 is slightly greater than the distance between the outer edges of slots 28 and 30 such that when housing 10 is mounted on the printed circuit board side members 12 and 14 are in slight lateral compression.

Contact members 32 and 34 are compressed against the surface of the printed circuit board 20 and as a result the upper surfaces of lips 16 and 18 are held in firm, but slideable, contact with the contiguous portion of the underside of the printed circuit board, and contact members 32 and 34 are in firm, but slideable, contact with the upper surface of the printed circuit board.

The length of segments 40 and 42 (FIG. 6) of the contact members relative to the spacing of the contact points or pads on printed circuit board 20 are such that when the housing is moved along slot 28 and 30 to the leftward extreme position (See FIG. 3), pad 21 is electrically connected to pad 25 through member 34. Similarly, when housing 10 is moved to the rightward extreme position, pad 22 is electrically connected to pad 23 through contact member 32 and pad 25 is electrically connected to pad 26 through member 34. It is understood, of course, that the implemented switching function is between the circuit (not shown) connected to pad 22 and the circuits connected to either pads 21 or 23; and between the circuit connected to pad 25 and the circuits connected to either pad 24 or 26. Also, the length of segments 40 and 42 of the contact members relative to the spacing of the contact points or pads determines whether a "make before break" or "break before make" type switch is implemented. For example, in switching from the left to right hand positions (FIG. 3) the length of the segment 40 determines whether or not pad 23 is contacted prior to losing contact with pad 21.

Figure 7:
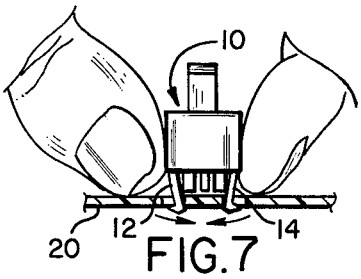
FIG. 7 is an end elevational view of the switching arrangement for illustrating the installation of the switch housing onto the printed circuit board.
Figure 8:
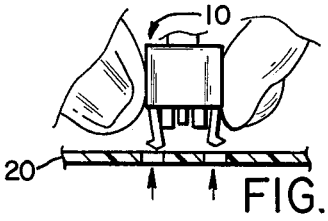
FIG. 8 is an end elevational view of the switching arrangement for illustrating the removal of the switch housing from the printed circuit board.

As shown in FIG. 7, housing 10 is easily mounted to the printed circuit board through the enlarged central portion of slots 28 and 30 (FIG. 3) by slightly compressing side members 12 and 14 with finger pressure. As shown in FIG. 8 the housing may be easily removed by compressing the side members and lifting the housing so that lips 16 and 18 pass through the central slot sections.

In the electrical device (not shown) of which printed circuit board 20 is a part, the board may be mounted contiguous to the chassis of the device such that knob 15 of housing 10 protrudes through an aperture in the chassis. Also, the associated electrical device may comprise two "stops" or posts (not shown) positioned to engage the respective semicircular end portions 42 and 44 (FIG. 1) of the housing at the two extreme switch positions thereof. This arrangement avoids large forces on the slotted areas of the printed circuit board during switching operations.

Figure 1:
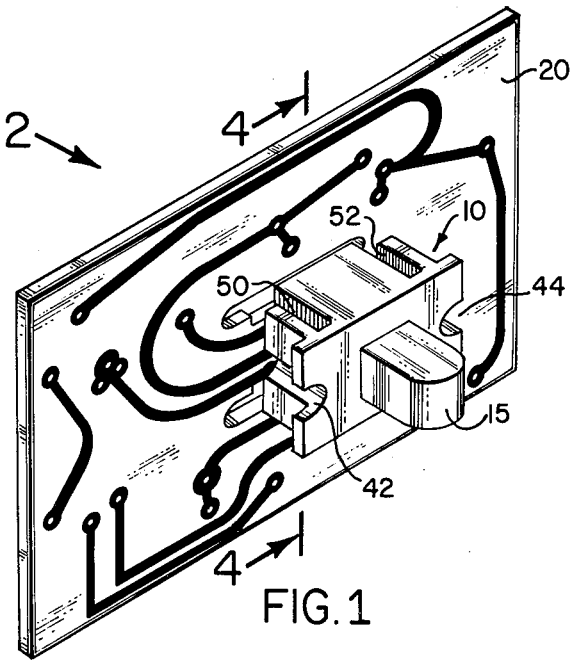
FIG. 1 is a perspective view of a double-pole-double-throw printed circuit switching arrangement in accordance with the subject invention.
Figure 2:
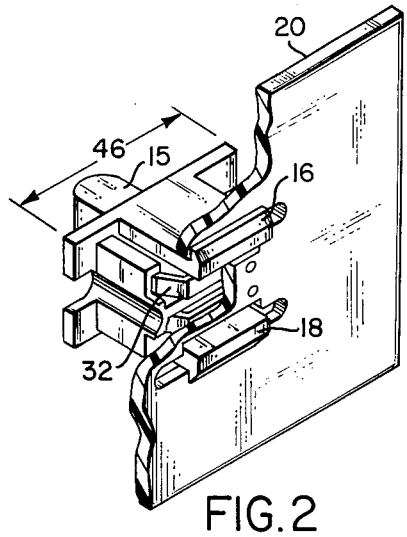
FIG. 2 is a perspective view of the back side of the arrangement of FIG. 1 with a portion of the printed circuit board broken away.

By way of an example of dimensions of one embodiment of a switching arrangement in accordance with the subject invention, as shown at 46 in FIG. 2, the overall length of housing 10 is 1.00 inches and the length of the center body portion 48 (FIG. 3) is 0.812 inches. In the illustrated embodiment the width of a side member is 0.500 inches. The side members 12 and 14 are separated by slots from the end of the housings, for example see slots 50 and 52 of FIG. 1, so as to provide the desired flexibility of these members for installation and removal of housing 10.

Figure 4:
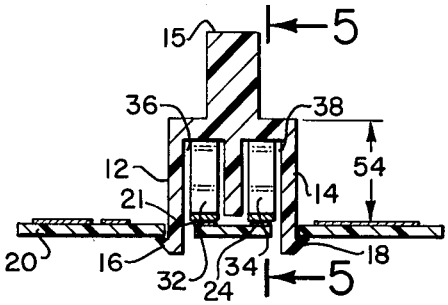
FIG. 4 is a sectional view taken along lines 4—4 of FIG. 1.
Figure 5:
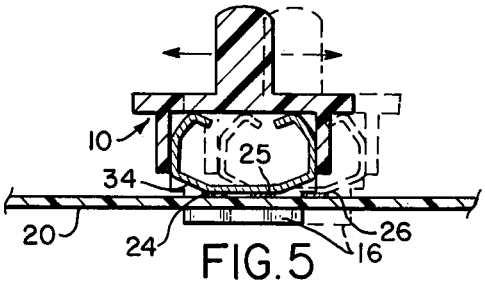
FIG. 5 is a sectional view taken along lines 5—5 of FIG. 4.
Figure 6:
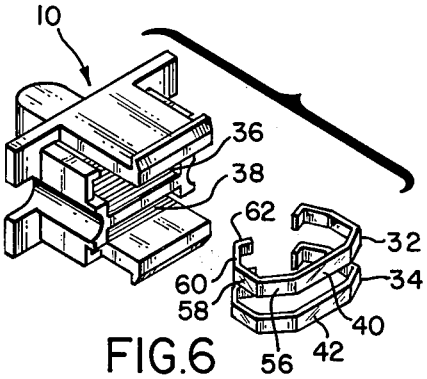
FIG. 6 is a perspective view of the switch housing with the two contact members removed therefrom.

The height of the main body portion of housing shown at 54 in FIG. 4 is .375 inches and the length of a side member is 0.500 inches. The thickness of the side member is 0.045 inches and the width at the lip portion is 0.090 inches. The height of each lip is 0.05 inches.

The spacing between side members is 0.440 inches, exclusive of a 1° outward slope from the vertical for each side member. As noted previously, this outward slope of the side members provides lateral pressure on the edges of slots 36 and 38 when the housing 10 is mounted onto printed circuit board 20.

Contact members 32 and 34 are identical and by way of example some typical dimensions therefor are given relative to member 32. Segment 40 of member 32 is 0.37 inches in length, segment 56 is 0.15 inches long and segment 56 forms angles of 30 and 60° with segments 40 and 58, respectively. Segment 60 forms angles of 30° and 75° with sections 58 and 62, respectively. The distance from the end of segment 58 to the extension of section 40 is 0.250 inches and the distance from the end of section 60 to the extension of section 40 is 0.400 inches. The member 32 is symetrical about the center of segment 40.

Members 32 and 34 may be constructed from tin plated hard spring brass which is 0.100 inches wide and .010 inches thick. However, any suitable electrically conductive material may be used.

Figure 9:
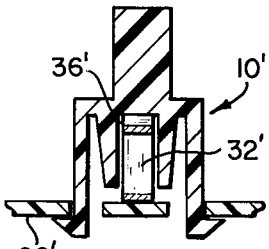
FIG. 9 is an end sectional view of a second embodiment of the invention which implements a single-pole-double-throw switching arrangement.

Although one double-pole-double-throw embodiment of the invention has been described in detail hereinabove relative to FIGS. 1–8, it will be understood that numerous adaptations thereto may be made. For example, in the single-pole-double-throw embodiment shown in FIG. 9, only a single contact member 32′ is mounted within cavity 36′ of switch housing 10′. Single contact member 32′ would operate with a single set of three contact points or pads in the same manner as described hereinabove relative to pads 21–23, for example. On the other hand, as many "poles" as desired may be implemented by adding parallel contact members within the body of housing 10, with associated sets of contact points or pads added to printed circuit board 20. Also, a single "throw" or more than a "double throw" switch may be implemented by reducing or increasing, respectively, the number of pads associated with each contact member.

Further, it is noted that the switching arrangement of the subject invention is not limited to printed circuit boards, per se, but is adaptable for use with any equivalent support structure which has contact points mounted thereon.

Thus having described a new and improved switching means for printed circuit boards or like devices,

What is claimed is:

1. A switching device for selectively connecting a first contact point on a printed circuit board or the like, with at least one other contact point thereon, said switching device being adapted for mounting through slots in the printed circuit board and comprising:

at least one electrically conductive slide contact member;

a housing having side members extending below the body thereof such that said side members may be inserted through respective slots in the printed circuit board, and having at least one cavity formed therein for mounting said slide contact member so that when said side members are inserted through said slots, a segment of said slide contact member contacts the surface of the printed circuit board, and with the length of said segment of the slide contact member and the spacing and position of said contact points being such that said first contact point may be selectively connected to at least one other contact point by the movement of said side members along said slots; and said side members each including an outwardly protruding lateral lip formed along the end thereof remote from the main portion of the housing and wherein the spacing between the side members relative to that of said slots in such that when the side members are projected through the slots the lips engage the underside of the printed circuit board contiguous to the outer edges of the slots, and said side members each being defined by spaced slots in the side wall of the housing body and are sloped outward from the vertical to the edges of said slots so that when inserted into said slots they provide pressure against the edges thereof.

2. The switching device of claim 1 wherein:

said housing includes a plurality of cavities therein adapted for mounting slide contact members, said device includes a plurality of slide contact members each of which is mounted within respective ones of said cavities and said printed circuit board includes sets of contact points disposed beneath the line of travel of each of said slide contact members.

3. A switching arrangement comprising:

a printed circuit board having two parallel slots formed therein and a plurality of contact points disposed between said slots;

at least one electrically conductive slide contact member;

a housing having side members extending below the body thereof such that said side members may be inserted through respective slots in the printed circuit board, and having at least one cavity formed therein for mounting said slide contact member so that when said side members are inserted through said slots, a segment of said slide contact member contacts the surface of the printed circuit board, and with the length of said segment of the slide contact member and the spacing and position of said contact points being such that said first contact point may be selectively connected to at least one other contact point by the movement of said side members along said slots; and said side members each including an outwardly protruding lateral lip formed along the end thereof remote from the main portion of the housing and wherein the spacing between the side members relative to that of said slots is such that when the side members are projected through the slots the lips engage the underside of the printed circuit board contiguous to the outer edges of the slots, and said side members each being defined by spaced slots in the side wall of the housing body and are sloped outward from the vertical to the edges of said slots so that when inserted into said slots they provide pressure against the edges thereof.

4. A switching arrangement comprising:

a printed circuit board having two parallel slots formed therein and a plurality of contact points disposed between said slots;

at least one electrically conductive slide contact member;

a housing having side members extending below the body thereof such that said side members may be inserted through respective slots in the printed circuit board, and having at least one cavity formed therein for mounting said slide contact member so that when said side members are inserted through said slots, a segment of said slide contact member contacts the surface of the printed circuit board, and with the length of said segment of the slide contact member and the spacing and position of said contact points being such that said first contact point may be selectively connected to at least one other contact point by the movement of said side members along said slots;

said side members each including an outwardly protruding lateral lip formed along the end thereof remote from the main portion of the housing and wherein the spacing between the side members relative to that of said slots is such that when the side members are projected through the slots the lips engage the underside of the printed circuit board contiguous to the outer edges of the slots, and said side members each being defined by spaced slots in the side wall of the housing body and are sloped outward from the vertical to the edges of said slots so that when inserted into said slots they provide pressure against the edges thereof; and wherein said slots each having enlarged segments which are slightly longer than the width of said side members, the width of said enlarged segments being sufficient to allow passage of the lips on said side members but the width of the other portions of said slots being too narrow to allow passage of said lips.

* * * * *